US012253016B1

(12) United States Patent
Firsich et al.

(10) Patent No.: US 12,253,016 B1
(45) Date of Patent: Mar. 18, 2025

(54) SYSTEM AND METHOD FOR CONTROLLING ELECTRICALLY HEATED CATALYST

(71) Applicant: FCA US LLC, Auburn Hills, MI (US)

(72) Inventors: Nicholas Firsich, Clarkston, MI (US); David Pedro, Techumseh (CA)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 18/624,458

(22) Filed: Apr. 2, 2024

(51) Int. Cl.
*F01N 3/20* (2006.01)
*F01N 9/00* (2006.01)

(52) U.S. Cl.
CPC ..... *F01N 3/2026* (2013.01); *F01N 9/00* (2013.01); *F01N 2900/0422* (2013.01); *F01N 2900/12* (2013.01); *F01N 2900/1411* (2013.01); *F01N 2900/16* (2013.01)

(58) Field of Classification Search
CPC .. F01N 3/2026; F01N 9/00; F01N 2900/0422; F01N 2900/12; F01N 2900/1411; F01N 2900/16
See application file for complete search history.

(56) References Cited

U.S. PATENT DOCUMENTS

2023/0399968 A1* 12/2023 Cox ..... F01N 3/2013

* cited by examiner

*Primary Examiner* — Brandon D Lee
(74) *Attorney, Agent, or Firm* — Jeremy J. Klobucar

(57) ABSTRACT

A control system for an exhaust system that receives a combusted air/fuel mixture as exhaust from the internal combustion engine includes a catalyst, an electric heating element and a controller. The electric heating element is disposed in the exhaust system upstream of the catalyst and is configured to heat up the exhaust before it enters the catalyst. The controller is configured to: estimate a temperature of the electric heating element at startup of the internal combustion engine; determine a time limit of operating the electric heating element at maximum power based on the estimated temperature of the electric heating element and an ambient temperature; and command the electric heating element to operate at the maximum power based on a determination that the time limit has not been reached.

16 Claims, 3 Drawing Sheets

SYSTEM AND METHOD FOR CONTROLLING ELECTRICALLY HEATED CATALYST

FIELD

The present application relates to vehicle emission systems and, more particularly, to techniques for controlling an electrically heated catalyst.

BACKGROUND

As is known, pollutant emissions such as nitrogen oxides (NOx), carbon monoxide (CO), and hydrocarbon (HC) are temperature sensitive in aftertreatment systems. Such emission conversion begins at high temperatures such as over 350C depending on catalyst formulation. Typically at engine startup, idle exhaust temperatures are much below the high temperatures needed for optimal catalyst efficiencies. An amount of time is needed for the exhaust to heat up from the typical exhaust temperatures to the elevated temperatures that satisfy a desired efficiency target. Operation of the engine during this heating up time is inefficient for conversion of such pollutants. Accordingly, a need exists in the art to improve upon efficiencies of aftertreatment systems.

SUMMARY

According to one example aspect of the disclosure, a control system for an exhaust system that receives a combusted air/fuel mixture as exhaust from the internal combustion engine includes a catalyst, an electric heating element and a controller. The electric heating element is disposed in the exhaust system upstream of the catalyst and is configured to heat up the exhaust before it enters the catalyst. The controller is configured to: estimate a temperature of the electric heating element at startup of the internal combustion engine; determine a time limit of operating the electric heating element at maximum power based on the estimated temperature of the electric heating element and an ambient temperature; and command the electric heating element to operate at the maximum power based on a determination that the time limit has not been reached.

In some implementations, the controller is further configured to determine, based on the time limit being reached, a power command to the electric heater based on an exhaust temperature and a mass flow of the exhaust.

In other implementations, the controller is configured to determine the time limit of operating the electric heating element at maximum power using a lookup table.

In additional implementations, the controller is configured to determine the power command to the electric heater using a lookup table.

In other examples, the controller is configured to receive the ambient temperature from an ambient temperature sensor.

In additional examples, the controller is configured to estimate the temperature of the electric heating element based on a time lapse between key-off and startup.

In additional examples, the control system further includes a power delivery module that regulates power from a battery into the electric heating element.

According to another example aspect of the disclosure, a method for controlling an exhaust system that receives combusted air/fuel mixture as exhaust from an internal combustion engine is provided. The exhaust system includes a catalyst that receives the exhaust and reduces nitrogen oxides, and an electric heating element disposed in the exhaust system upstream of the catalyst and that heats up the exhaust before it enters the catalyst. The method includes estimating, at a controller, a temperature of the electric heating element at startup of the internal combustion engine; determining, at the controller, a time limit of operating the electric heating element at maximum power based on the estimated temperature of the electric heating element and an ambient temperature; and commanding, at the controller, the electric heating element to operate at the maximum power based on a determination that the time limit has not been reached.

In some implementations, the method includes determining, at the controller, based on the time limit being reached, a power command to the electric heater based on an exhaust temperature and a mass flow of the exhaust.

In some implementations, the method includes determining, at the controller, the time limit of operating the electric heating element at maximum power using a lookup table.

In other implementations, the method includes determining, at the controller, the power command to the electric heater using a lookup table.

In additional implementations, the method includes estimating, at the controller, the temperature of the electric heating element based on a temperature of the electric heating element at key-off of the internal combustion engine In additional implementations, the method includes estimating the temperature of the electric heating element based on a time lapse between key-off and startup.

In additional implementations, the method includes regulating power, at a power delivery module, from a battery into the electric heating element.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

The present disclosure is directed toward emission control on vehicles having internal combustion engines (ICE). As discussed above, typically at engine startup, idle exhaust temperatures are much below the high temperatures needed for optimal catalyst efficiencies. An amount of time is needed for the exhaust to heat up from the typical exhaust temperatures to the elevated temperatures that satisfy a desired efficiency target. Operation of the engine during this heating up time is inefficient for conversion of such pollutants. Some emission control systems incorporate an electrically heated catalyst (EHC) in the exhaust to warm the catalyst. The EHC includes a heating element that can be used to reduce the amount of time needed to heat the catalyst by producing heat before or after the ICE starts. The ability to warm the catalyst quickly has the potential to greatly reduce exhaust emissions since most harmful emissions are produced when the ICE and catalyst are cold. In such examples however, there is no control strategy implemented for the EHC.

The present disclosure provides a system and method that regulates the power of the heating element in the EHC. In particular, the methods disclosed herein allow the heating element to be heated as quickly as possible at startup by commanding maximum power for a specified amount of time based on initial conditions of the vehicle. After startup, the methods use a time determination module to output a steady state power command. In examples, the time determination module implements a lookup table based on exhaust temperature and mass flow to determine a steady state power command. The combination of this control strategy with the relatively slow dynamics of the heating element provides great transient behavior and prevents overheating.

Figure 1:
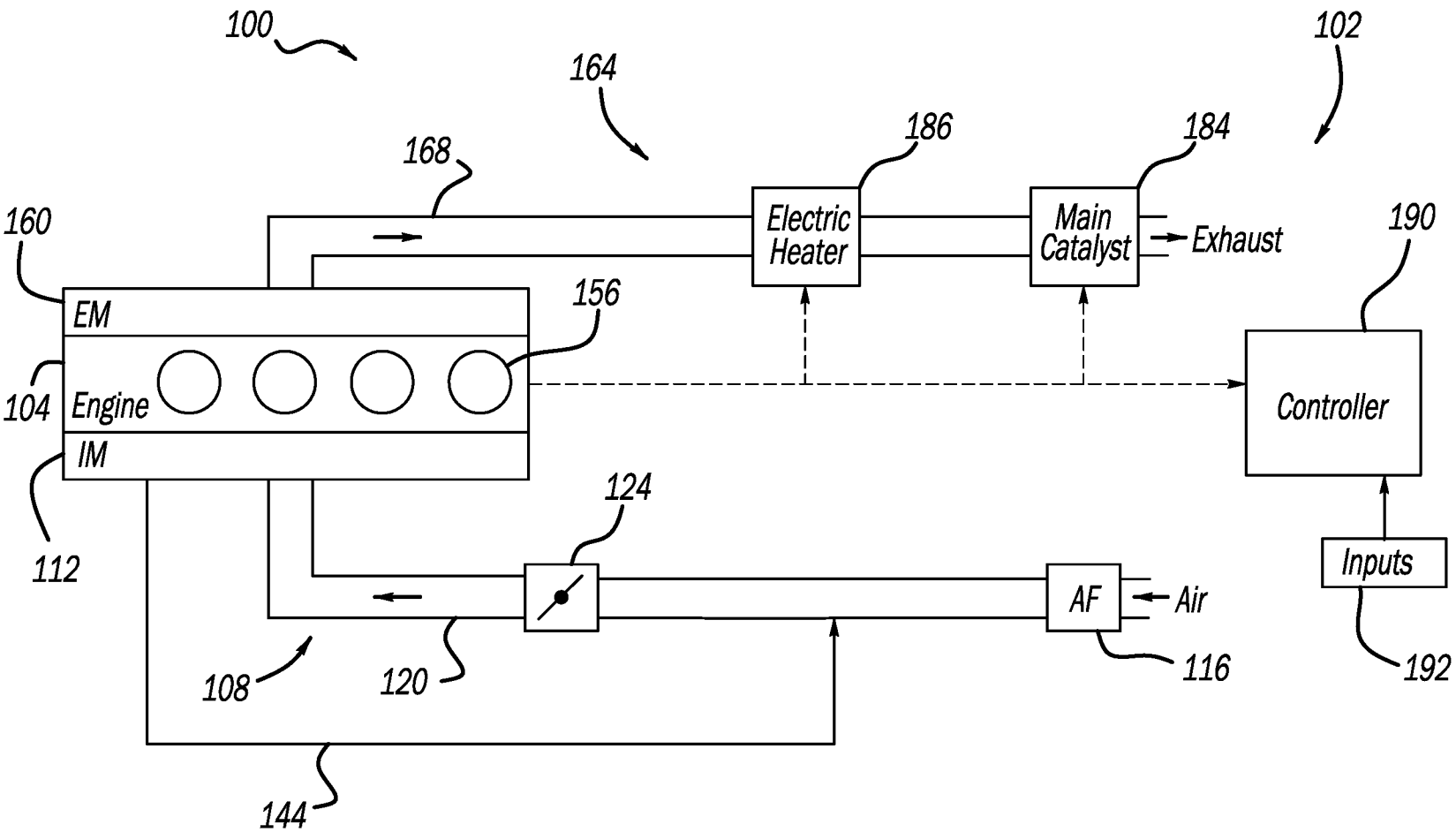
FIG. 1 is a diagram of an example vehicle control system comprising an electrically heated catalyst (EHC) according to the principles of the present disclosure.

Referring now to FIG. 1, a diagram of an example vehicle 100 that implements a control system 102 is illustrated. The vehicle 100 includes an engine 104 configured to combust an air/fuel mixture to generate drive torque. The engine 104 includes an intake system 108 that draws fresh air into an intake manifold (IM) 112 through an air filter (AF) 116 and an induction passage 120. A throttle valve 124 regulates a flow of air through the induction passage 120.

The inducted air is distributed to a plurality of cylinders 156 and combined with fuel (e.g., from respective direct-injection or port-injection fuel injectors) to form an air/fuel mixture. While four cylinders are shown, it will be appreciated that the engine 104 could include any number of cylinders. Further, the engine 104 can be configured with additional features such as, but not limited to, a turbocharger and/or supercharger within the scope of the present disclosure. The air/fuel mixture is compressed by pistons (not shown) within the cylinders 156 and combusted (e.g., via spark from respective spark plugs) to drive the pistons, which turn a crankshaft (not shown) to generate drive torque. The drive torque is then transferred to a driveline (not shown) of the vehicle 100, e.g., via a transmission (not shown). Exhaust gas resulting from combustion is expelled from the cylinders 156 and into an exhaust manifold (EM) 160 of the engine 104.

The exhaust gas from the exhaust manifold 160 is provided to an exhaust system 164 comprising an exhaust passage 168. Exhaust gas is fed through a main catalyst 184 prior to being expelled into the atmosphere (e.g., through a vehicle tailpipe). An electric heater 186 is disposed in the exhaust passage 186 generally upstream of the main catalyst 184. The electric heater 186 and main catalyst 184 can collectively be referred to herein as the EHC. The electric heater 186 is used to heat the exhaust air before it enters the catalyst 184.

The electric heater 186 can be commanded in one scenario to pre-heat the catalyst 184 before the engine 104 starts. The electric heater 186 can also be commanded in another scenario subsequent to engine startup such that the exhausted air is heated prior to entering the catalyst 184 to heat up the catalyst faster. In yet another scenario, the electric heater 186 can be commanded to actively heat. In such a scenario, prior to starting the vehicle 100 a supplemental pump (not shown) can be used to push air through the electric heater 186 to warm the catalyst 184. Other scenarios for using the electric heater 186 are contemplated and within the scope of the present disclosure.

A controller, also referred to herein as an engine controller, 190 implements the control system 102 and controls operation of the vehicle 100. Examples of components controlled by the controller 190 include the engine 104, the throttle valve 124, and the electric heater 186. It will be appreciated that the controller 190 controls specific components of the vehicle 100 that are not illustrated, such as, but not limited to, fuel injectors, spark plugs, an EGR valve, a VVC system (e.g., intake/exhaust valve lift/actuation), a transmission, and the like. The controller 190 controls operation of these various components based on measured and/or modeled parameters. Inputs 192 such as one or more sensors are configured to measure one or more parameters, and communicate signals indicative thereof to the controller 190 (pressures, temperatures, speeds, etc.) as discussed in greater detail herein. Other parameters could be modeled by the controller 190, e.g., based on other measured parameters. The controller 190 is also configured to perform the electric heater control techniques.

Figure 2:
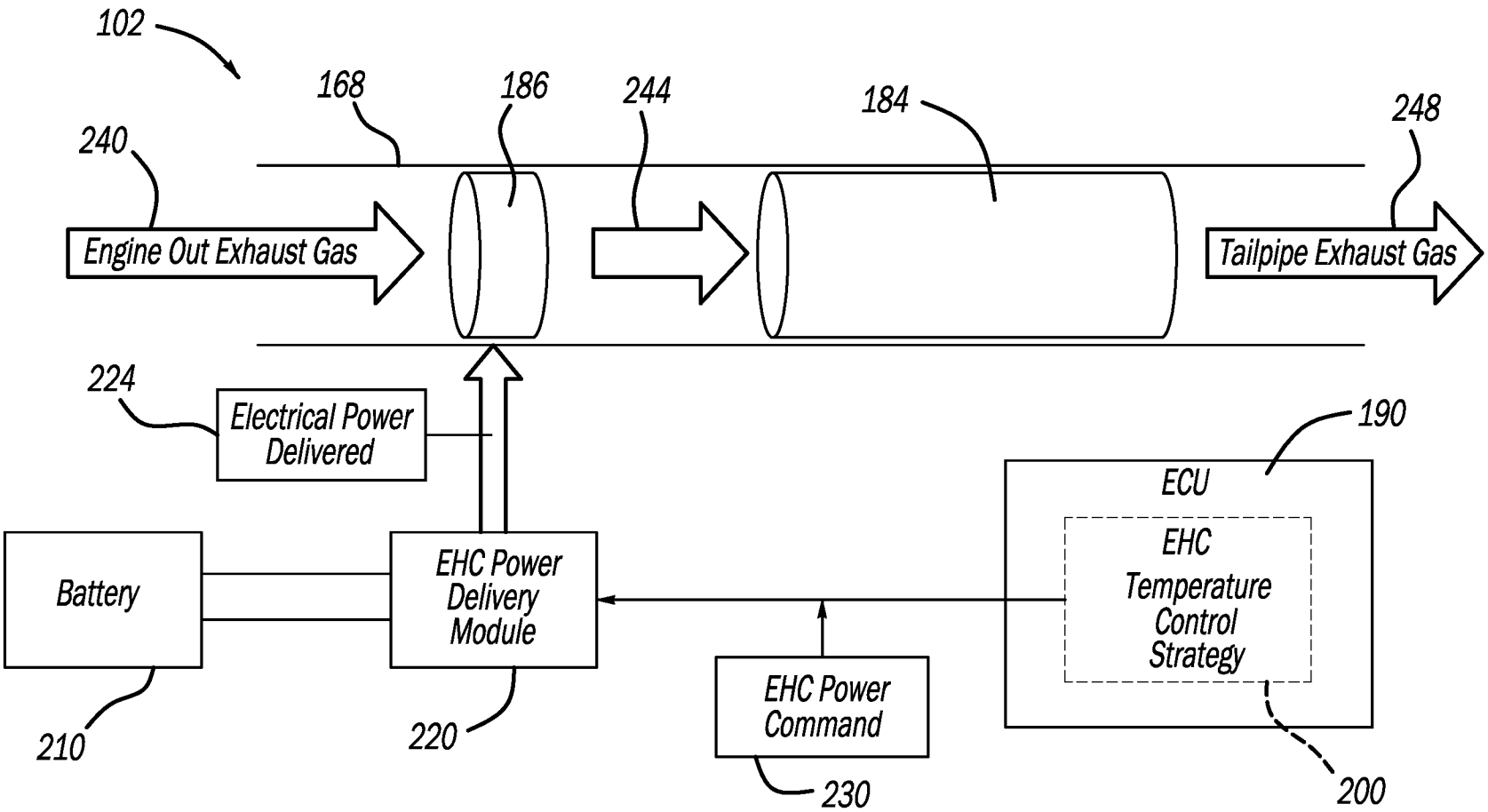
FIG. 2 is a schematic representation of a control strategy implemented by the control system according to examples of the present disclosure.

Turning now to FIG. 2, an EHC control strategy 200 implemented by the control system 102 according to examples of the present disclosure will be described. The EHC control strategy 200 is implemented by the controller (e.g., electronic control unit, ECU) 190. The control system 102 further includes a battery 210 and an EHC power delivery module 220. The EHC power delivery module 220 allows power 224 from the battery 210 to flow into the heating element 186. The ECU 190 sends an EHC power command 230 to the EHC power delivery module 220 for controlling the heating of the heating element 186 as will be described in greater detail herein.

Engine out exhaust gas 240 from the exhaust manifold 160 flows through the heating element 186 and is heated. Heated exhaust gasses 244 exiting from the heating element 186 are directed into the catalyst 184 where they are treated before exiting as tailpipe exhaust emissions 248. In examples, the EHC control strategy 200 aims to operate the heating element 186 at very high temperatures, for example, but not limited to 800 degrees Celsius. The control strategy 200 further protects from overheating the heating element 186 so as not to damage it.

Figure 3:
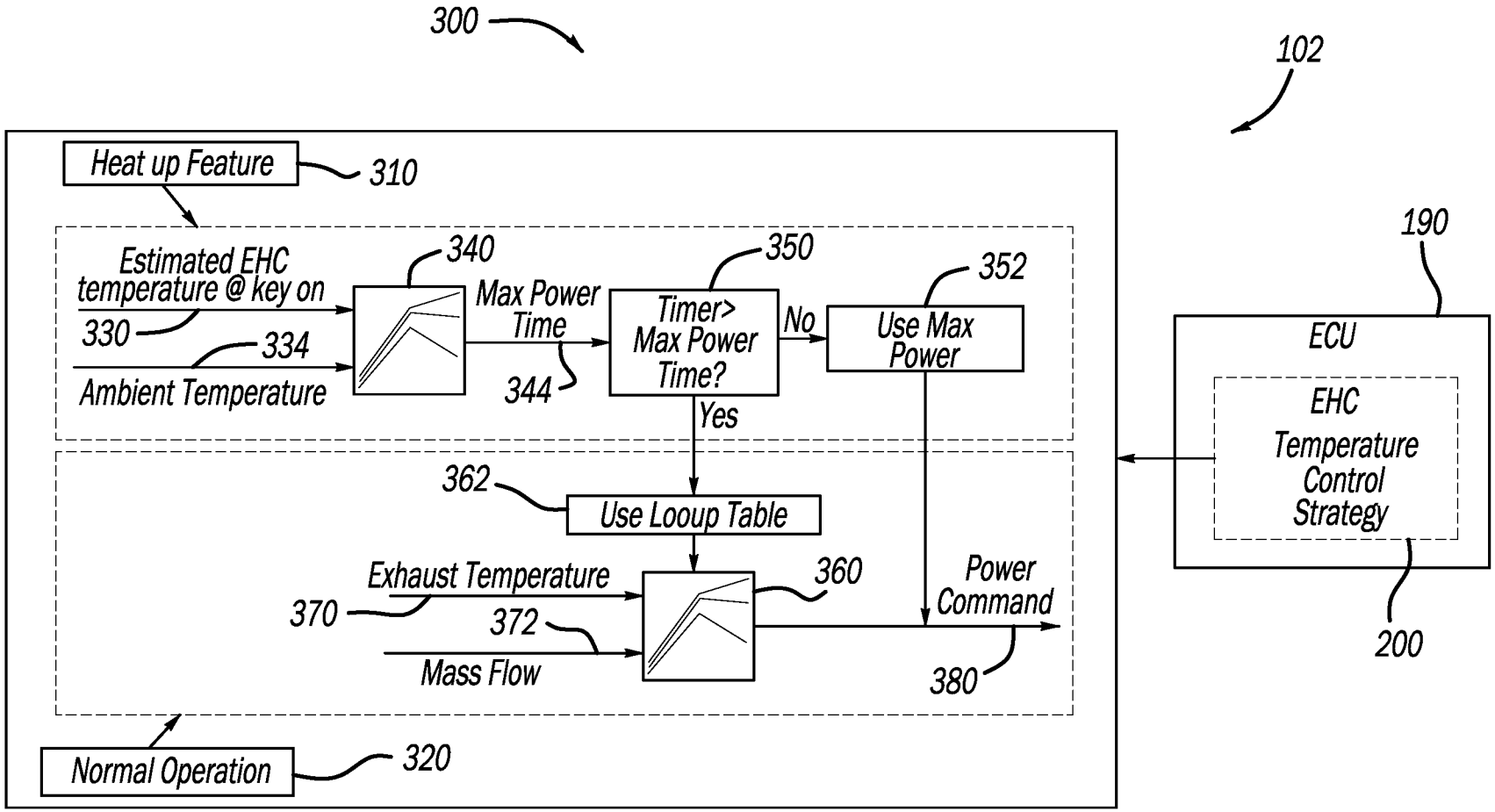
FIG. 3 is an exemplary logic flow diagram illustrating a method for implementing the control strategy of FIG. 2 according to examples of the present disclosure.

With additional reference to FIG. 3, an exemplary logic flow diagram illustrating a method 300 for operating the control system 102 of FIG. 2 according to examples of the present disclosure will be described. The control system 102 includes a heat up module 310 and a normal operation module 320. The heat up module 310 is used to input maximum power into the electronic heating element 186 to heat the electronic heating element 186 up as fast as possible. Once the electronic heating element 186 reaches its maximum power, control levels the power back to a more steady state operation. Control receives an estimated EHC temperature at key on at 330.

The estimated EHC temperature can be provided by various methods. In one method, at key off, the ECU 190 can run an algorithm that identifies the temperature of the heating element 186 at key off. The temperature can be determined by any methods such as by sensors that provide inputs 192. The algorithm can take into account various parameters such as, but not limited to, key off temperature of the heating element 186, how much time has passed, environmental conditions (e.g., ambient temperature, etc.).

Ambient temperature 334 is also received by control. The ambient temperature can be determined by any method such as, but not limited to, a temperature sensor that provides a temperature input 192.

Control implements a time determination module 340 that outputs a maximum power time 344 based on the estimated EHC temperature 330 and the ambient temperature 334. In examples, the time determination module 340 can be a lookup table. At 350 control initiates a timer and compares the time on the timer to the maximum power time 344 output by the time determination module 340. The maximum power time corresponds to a determined time limit of operating the electric heater 186 at the maximum power based on the estimated EHC temperature 330 and the ambient temperature 334. If the timer does not have a time that is greater than the maximum power time, control commands the electric heater 186 to use maximum power at 352.

If control determines that the timer has exceeded the maximum power time at 350, control proceeds to normal operation module 320. In the normal operation module 320, control implements a power determination module 360, such as in the form of a lookup table 362. The power determination module 360 receives an exhaust temperature 370 and a mass flow 372 of the exhaust as inputs and outputs a power command 380 to the electronic heating element 186.

It will be appreciated that the term "controller" as used herein refers to any suitable control device or set of multiple control devices that is/are configured to perform at least a portion of the techniques of the present disclosure. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. A control system for an exhaust system that receives a combusted air/fuel mixture as exhaust from an internal combustion engine, the control system comprising:

a catalyst that receives the exhaust and reduces nitrogen oxides;

an electric heating element disposed in the exhaust system upstream of the catalyst and configured to heat up the exhaust before it enters the catalyst;

a controller configured to:

estimate a temperature of the electric heating element at startup of the internal combustion engine;

determine a time limit of operating the electric heating element at maximum power based on the estimated temperature of the electric heating element and an ambient temperature; and command the electric heating element to operate at the maximum power based on a determination that the time limit has not been reached.

2. The control system of claim 1, wherein the controller is further configured to:

determine, based on the time limit being reached, a power command to the electric heating element based on an exhaust temperature and a mass flow of the exhaust.

3. The control system of claim 1, wherein the controller is configured to determine the time limit of operating the electric heating element at maximum power using a lookup table.

4. The control system of claim 2, wherein the controller is configured to determine the power command to the electric heating element using a lookup table.

5. The control system of claim 1, wherein the controller is configured to:

receive the ambient temperature from an ambient temperature sensor.

6. The control system of claim 5, wherein the controller is configured to:

estimate the temperature of the electric heating element based on a temperature of the electric heating element at key-off of the internal combustion engine.

7. The control system of claim 6, wherein the controller is further configured to estimate the temperature of the electric heating element based on a time lapse between key-off and startup.

8. The control system of claim 1, further comprising:

a power delivery module that regulates power from a battery into the electric heating element.

9. A method for controlling an exhaust system that receives combusted air/fuel mixture as exhaust from an internal combustion engine, the exhaust system including a catalyst that receives the exhaust and reduces nitrogen oxides, an electric heating element disposed in the exhaust system upstream of the catalyst and that heats up the exhaust before it enters the catalyst, the method comprising:

estimating, at a controller, a temperature of the electric heating element at startup of the internal combustion engine;

determining, at the controller, a time limit of operating the electric heating element at maximum power based on the estimated temperature of the electric heating element and an ambient temperature; and commanding, at the controller, the electric heating element to operate at the maximum power based on a determination that the time limit has not been reached.

10. The method of claim 9, further comprising:

determining, at the controller, based on the time limit being reached, a power command to the electric heating element based on an exhaust temperature and a mass flow of the exhaust.

11. The method of claim 9, further comprising:

determining, at the controller, the time limit of operating the electric heating element at maximum power using a lookup table.

12. The method of claim 10, further comprising:

determining, at the controller, the power command to the electric heating element using a lookup table.

13. The method of claim 9, further comprising:

receiving, at the controller, the ambient temperature from an ambient temperature sensor.

14. The method of claim 13, further comprising:

estimating, at the controller, the temperature of the electric heating element based on a temperature of the electric heating element at key-off of the internal combustion engine.

15. The method of claim 14, further comprising:

estimating the temperature of the electric heating element based on a time lapse between key-off and startup.

16. The method of claim 9, further comprising:

regulating power, at a power delivery module, from a battery into the electric heating element.

* * * * *